US006412547B1

(12) United States Patent
Siler

(10) Patent No.: US 6,412,547 B1
(45) Date of Patent: Jul. 2, 2002

(54) HEAT EXCHANGER AND METHOD OF MAKING THE SAME

(75) Inventor: Nicholas R. Siler, Franksville, WI (US)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 09/679,123

(22) Filed: Oct. 4, 2000

(51) Int. Cl.[7] ..... F28F 9/007

(52) U.S. Cl. ..... 165/81; 165/149; 228/183; 29/890.03

(58) Field of Search ..... 165/81, 149; 29/890.03; 228/183

(56) References Cited

U.S. PATENT DOCUMENTS 4,719,967 A * 1/1988 Scarselletta ..... 165/76
4,876,778 A * 10/1989 Hagihara et al. ..... 29/890.03
5,174,366 A * 12/1992 Nagakura et al. ..... 165/77
5,186,239 A * 2/1993 Young et al. ..... 165/81
5,954,123 A * 9/1999 Richardson ..... 165/81
6,129,142 A * 10/2000 Beldam ..... 165/51
6,328,098 B1 12/2001 Kodumudi et al.

* cited by examiner

*Primary Examiner*—Allen Flanigan
(74) *Attorney, Agent, or Firm*—Wood, Phillips, VanSanten, Clark & Mortimer

(57) ABSTRACT

Thermally induced stress tending to cause breakage or leakage at tube to header joints in a heat exchanger is eliminated by placing lines of weakening in the side plates conventionally employed in such heat exchanger prior to subjecting the heat exchanger to brazing.

14 Claims, 2 Drawing Sheets

10
12
14
16
18
20
22
24
26
28
30
32
34
36
38
40
42
44
46
48
50
52
54
56
60
62
64
72
18,20
5

HEAT EXCHANGER AND METHOD OF MAKING THE SAME

FIELD OF THE INVENTION

This invention relates to heat exchangers, and more specifically, to improved side pieces for heat exchangers; as well as methods of making a heat exchanger.

BACKGROUND OF THE INVENTION

Many heat exchangers in use today, as, for example, vehicular radiators, oil coolers, and charge air coolers, are based on a construction that includes two spaced, generally parallel headers which are interconnected by a plurality of spaced, parallel, flattened tubes. Located between the tubes are thin, serpentine fins. In the usual case, the side most tubes are located just inwardly of side plates on the heat exchanger and serpentine fins are located between those side most tubes and the adjacent side plate.

The side plates are typically, but not always, connected to the headers to provide structural integrity. They also play an important role during the manufacturing process, particularly when the heat exchanger is made of aluminum and components are brazed together or when the heat exchanger is made of other materials and some sort of high temperature process is involved in the assembly process.

More particularly, conventional assembly techniques involve the use of a fixture which holds a sandwiched construction of alternating tubes and serpentine fins. The outside of the sandwich, that is the outer layers which eventually become the sides of the heat exchanger core, is typically provided with side pieces whose ends are typically connected mechanically to the headers. Pressure is applied against the side pieces to assure good contact between the serpentine fins and the tubes during a joining process such as brazing to assure that the fins are solidly bonded to the tubes to maximize heat transfer at their points of contact. If this is not done, air gaps may be located between some of the crests of the fins and the adjacent tube which adversely affect the rate of heat transfer and durability, such as the ability to resist pressure induced fatigue and to withstand elevated pressures.

At the same time, when the heat exchanger is in use, even though the side plates may be of the same material as the tubes, because a heat exchange fluid is not flowing through the side plates but is flowing through the tubes, the tubes will typically be at a higher temperature than the side plates, at least initially during the start up of a heat exchange operation.

This in turn results in high thermal stresses in the tubes and headers. Expansion of the tubes due to relatively high temperatures tends to push the headers apart while the side plates, at a lower temperature, tend to hold them together at the sides of the core. All too frequently, this severe thermal stress in the heat exchanger assembly results in fracture or the formation of leakage openings near the tube to header joints which either requires repair or the replacement of the heat exchanger.

It has been proposed to avoid this problem, after complete assembly of the heat exchanger, by sawing through the side plates at some location intermediate the ends thereof so that thermal expansion of the tubes is accommodated by the side plates, now in multiple sections, which may move relative to one another at the saw cut. However, this solution adds an additional operation to the fabrication process and consequently is economically undesirable.

SUMMARY OF THE INVENTION

It is the principal objection of the invention to provide a new and improved heat exchanger, and a method of making the same, that eliminates heat exchanger failure problems due to thermally induced stresses resulting from a difference in thermal expansion between the expansion of the tubes of the heat exchanger and the expansion of the side pieces thereof. It is also an object of the invention to provide a method of making such a heat exchanger.

According to one facet of the invention, there is provided a heat exchanger that includes a pair of spaced, generally parallel headers, a plurality of spaced, generally parallel tubes extending between and in fluid communication with the interior of the headers, a pair of elongated side plates, one at each side of the heat exchanger, and extending between and connected to the headers and spaced from the adjacent tube at the corresponding side of the heat exchanger. Serpentine fins are disposed between adjacent tubes as well as between the side plates and the tubes adjacent thereto. The invention contemplates the improvement wherein each side plate includes at least one opening between its edges which has a periphery with a part of the periphery in close proximity to at least one of the edges along with a score line in each side plate that extends from the part of the periphery to the edge. As a consequence, thermally induced stress will cause the side piece to sever at the location of the opening and the score line and thereafter the stress at tube to header joints or the like is relieved on a permanent basis.

According to one embodiment of the invention, the opening is elongated and is at an acute angle to the direction of elongation of the corresponding side plate.

A preferred embodiment contemplates that the side plate is formed as a channel having a base with at least one leg extending therefrom terminating at the one edge. The opening is formed in the base and in the one leg and the score line is in the one leg.

In a highly preferred embodiment, there is provided a heat exchanger generally as stated previously with the invention contemplating the improvement wherein each side plate is channel shaped having abase and two spaced outstanding legs extending from the base and terminating at opposite edges. First and second, elongated openings are disposed in each of the side plates in side by side relation and have respective center lines that intersect in an acute angle. Each of the openings has a periphery that includes a first part in close proximity to a corresponding one of the edges and a second part in close proximity to the other of the openings. The first and second parts are spaced from one another in the direction of elongation of the side piece and a first line of weakening is located at each of the first parts and extends between a corresponding one of the openings and the adjacent one of the edges. A second line of weakening extends between the openings at the second part.

As a consequence of this construction, the side plates may sever at the lines of weakening to relieve stresses as before. Moreover, the formation of the side plate as a channel and the effective staggering of the first and second lines of weakening does not materially reduce the bending strength or resistance to bending of the side plate so that a high degree of structural integrity is maintained prior to assembly of the side plates to the core. This accomplishes two purposes: It allows handling of the side pieces prior to assembly to the core without requiring great care on the part of the persons that must handle the side pieces; and it distributes the expansion stress that otherwise would be focused at the location of severance.

In a preferred embodiment, the acute angle is on the order of 90°.

Preferably, the first and second lines of weakening are defined by V-shaped notches in the legs and in the base of the channel respectively.

In a highly preferred embodiment, the lines of weakening have a length of about 4.6 mm or less.

The invention also contemplates the provision of a method of making an aluminum heat exchanger which includes the steps of: (a) assembling the components of a heat exchanger core in a fixture to have spaced headers, spaced tubes extending between the headers, side plates extending between the headers at the sides of the core and serpentine fins located between adjacent tubes as well as between the side plates and the adjacent tube at each side of the core; (b) mechanically fixing each end of the side plate to the adjacent header; (c) prior to steps (a) and (b), weakening the side plate at a point intermediate its ends so as to reduce its ability to withstand tension while not materially affecting its ability to withstand bending; and (d) subjecting the assembly resulting from step (b) to brazing temperatures to (i) braze the components together and (ii) allow the severance of each side piece at said point as a result of thermally induced stress. Whether services will in fact occur generally depends on the rate at which the brazed components cool following brazing.

Other objects and advantages will become apparent from the following specification taken in connection with the accompanying drawings.

DESCRIPTION OF THE PREFERRED EMBODIMENTS

The present invention will be described hereinafter as a vehicular radiator, as, for example, a radiator for a large truck. However, it should be understood that the invention is applicable to radiators used in other contexts, for example, a radiator for any vehicle or for stationary application as an internal combustion engine driven generator. The invention is also useful in any of the many types of heat exchangers that utilize side plates to hold serpentine fins against parallel tubes extending between spaced headers, for example, oil coolers and charge air coolers. Accordingly, no limitation to any particular use is intended except insofar as expressed in the appended claims.

Figures 1, 2, 3:
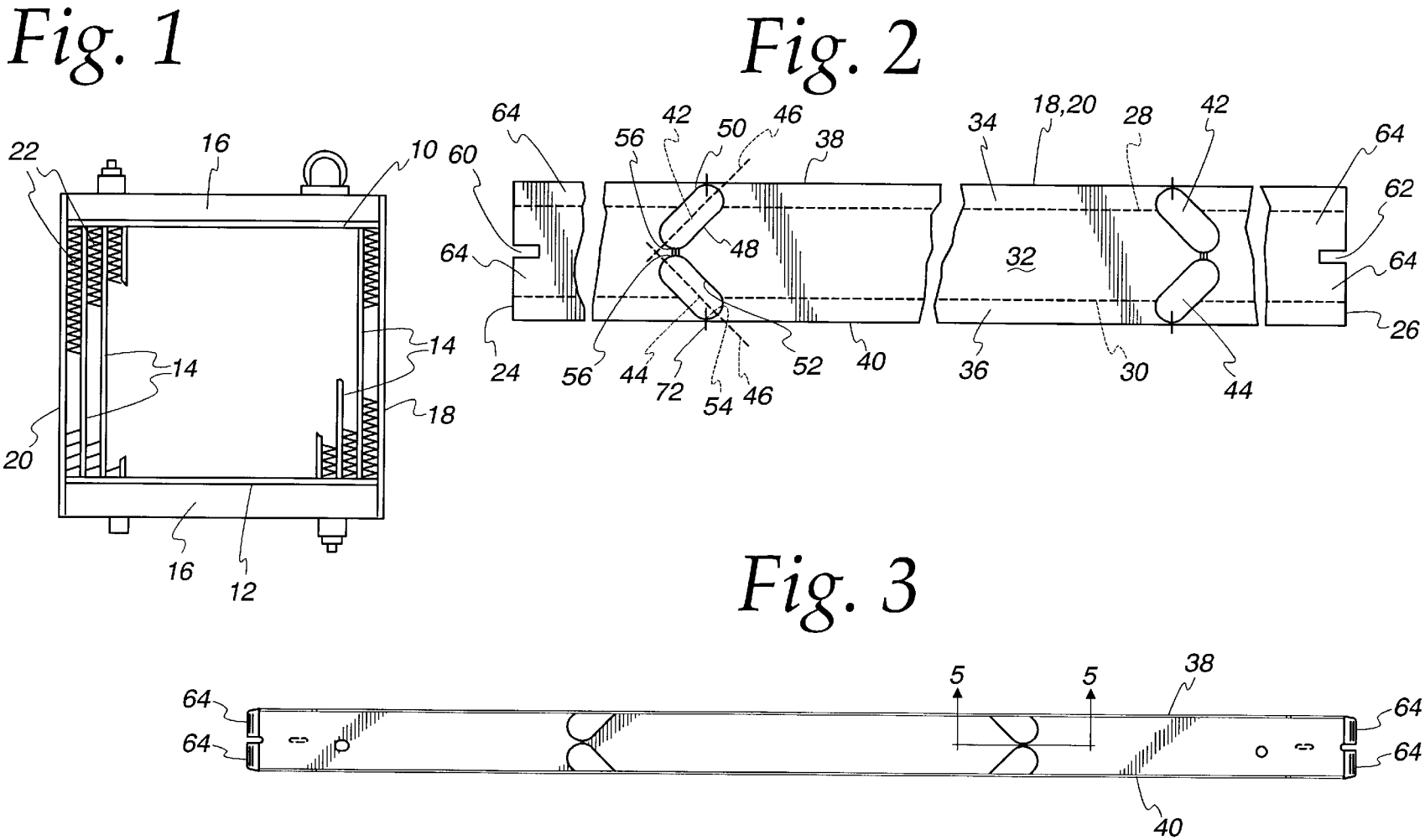
FIG. 1 is a somewhat schematic, side elevation of a heat exchanger made according to the invention.
FIG. 2 is a fragmentary, plan view of a partially fabricated side plate made according to the invention.
FIG. 3 is a plan view of a fully fabricated side plate.

Referring to FIG. 1, a typical heat exchanger of the type of concern includes spaced, parallel header plates 10, 12, between which a plurality of flattened tubes 14 extend. The tubes 14 are spaced from one another and their ends are brazed or welded or soldered and extend through slots, not shown, in the headers 10 and 12 so as to be in fluid communication with the interior of a tank 16 fitted to each of the headers 10, 12. In this regard, it is to be noted that as used herein, the term "header" collectively refers to the header plates 10, 12, to the headers 10, 12 with the tanks 16 secured thereon, or integral header and tank constructions known in the art as, for example, made by tubes or various laminating procedures. Side pieces 18, 20 flank respective sides of the heat exchanger construction and extend between the headers 10, 12 and are typically mechanically connected thereto as well as metallurgically bonded thereto.

Between the spaced tubes 14, and between the endmost tube 14 and an adjacent one of the side plates 18, 20 are conventional serpentine fins 22. As is well known, the fins 22 may be formed of a variety of materials. Typical examples are aluminum, copper and brass. However, other materials can be used as well depending upon the desired strength and heat exchange efficiency requirements of a particular application.

In a highly preferred embodiment of the invention, all of the just described components, with the possible exception of the tanks 16 which may be formed of plastic, are formed of aluminum or aluminum alloy and are braze clad at appropriate locations so that an entire assembly is illustrated in FIG. 1 may be placed in a brazing oven and the components all brazed together. In the usual case, prior to brazing, an appropriate fixture is employed to build up a sandwich made up of the tubes 14 alternating with the serpentine fins 22 and capped at each end by the side plates 18 and 20. The headers 10, 12 are fitted to the ends of the tubes 14 and in the usual case, the side plates 18 and 20 may be mechanically coupled to the headers 10, 12 typically by bending tabs on the side plates 18 over the corresponding ends of the headers 10, 12.

FIG. 2 illustrates a partially fabricated preform for making up the side plates 18, 20. As illustrated, it is elongated and has header connecting ends 24, 26. Non-existing bend lines shown only for the purpose of illustrating the position of a bend to be formed in the side plates are illustrated at 28 and 30. Ultimately, the strips shown in FIG. 2 will be bent along the lines 28 and 30 to form a channel having a base 32 flanked by upstanding legs 34, 36 which are spaced from one another and which terminate in respective, opposite edges 38, 40. While a channel cross section is preferred, in some cases, the side plates 18, 20 may remain generally planar or flat.

The strip is weakened intermediate its ends by the provision of at least one opening 42 at one or more locations between the ends 24, 26 of the strip. In a preferred embodiment, an opening 42 is paired with an opening 44. The openings 42, 44 are generally in the form of an oval with each having a center line 46 that coincide with the major axis of the associated opening 42, 44. The center lines of the openings 42, 44 intersect one another at an acute angle to form a V-shape. In a highly preferred embodiment, the angle of intersection is 90°, and each center line is at 45° to the longitudinal axis of the side plate.

Figure 5:
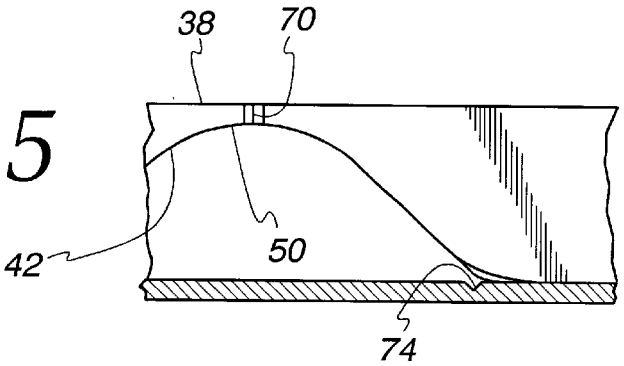
FIG. 5 is an enlarged sectional view taken approximately along the line 5—5 in FIG. 3.

The opening 42 has a periphery 48 that includes a part 50 in close adjacency to the edge 38. As seen in FIG. 5, the spacing between the part 50 of the periphery 48 and the edge 38, in a highly preferred embodiment, is 1.6 mm. However, other values may be utilized as will become apparent to those skilled in the art hereinafter.

The opening 44 likewise has a periphery 52 with a part 54 in close adjacency to the edge 40. Again, the spacing between the part 54 will be 1.6 mm in a highly preferred embodiment.

Figure 6:
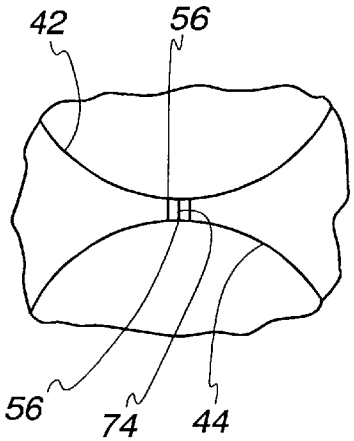
FIG. 6 is an enlarged, fragmentary view of part of the side plate.
Figure 4:
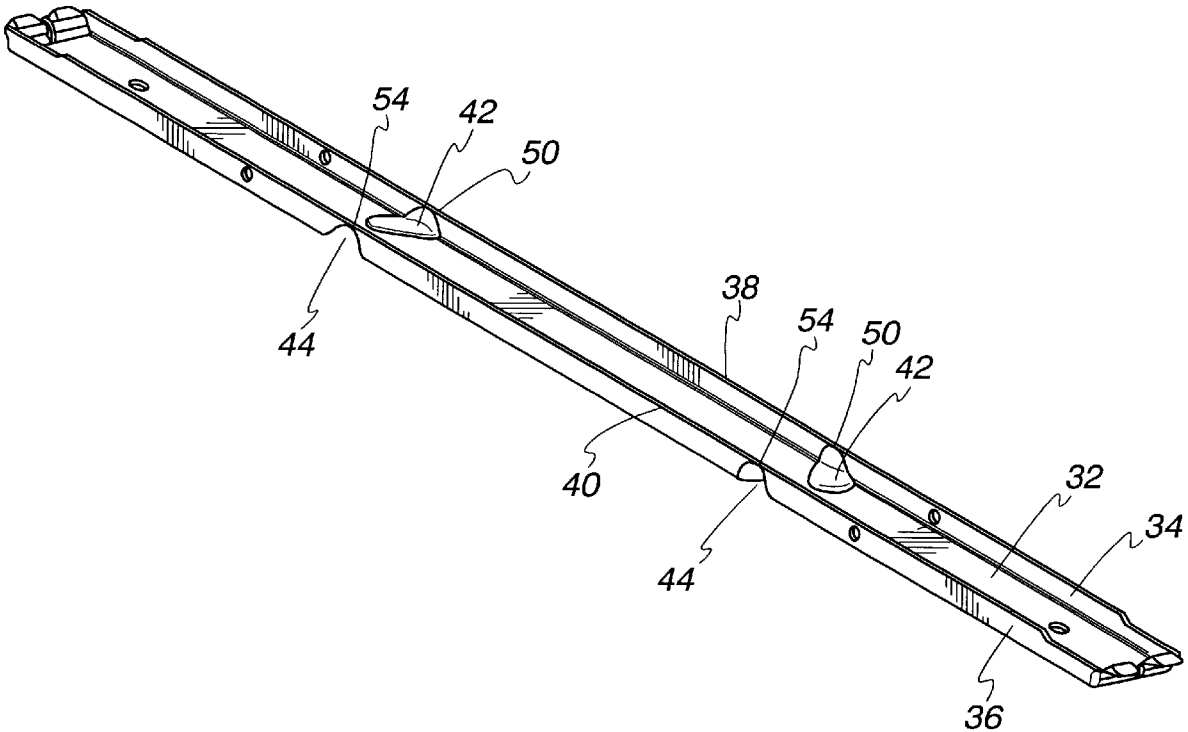
FIG. 4 is a perspective view of a fully fabricated side plate.

The peripheries 48 and 52 of the openings 42 and 44 also have parts 56 that are closely adjacent to the corresponding part of the other of the openings 42, 46. As shown in FIG. 6, the parts 56 of the openings 42 and 44 are spaced from one another a distance of 3.2 mm although other values may be employed. In general, the dimension will be 4.6 mm or less.

In the embodiment illustrated, there are two sets of the openings 42, 44 at different locations between the ends 24, 26 of the side piece.

The side piece may be provided, at its ends 24, 26 with notches 60, 62 which then define tabs 64 which may be bent about the ends of the headers 10, 12 or received in slots therein to mechanically secure the side plates 18, 20 to the assemblage prior to brazing.

One significant feature of the invention is the provision of lines of weakening in each side plate. Thus, at the part 50 of the periphery 48 of the opening 42, a line of weakening 70 extends to the adjacent edge 38 of the side plates. A similar line of weakening 72 is located at the part 54 of the periphery 52 of the opening 44 and extends to the edge 40 of the side plate.

In addition, a line of weakening 74 extends between the openings 42,44 at those parts 56 of their peripheries 48, 52 which are in close adjacency. It will be observed that the lines of weakening 70, 72, 74 are spaced from each other along the length of the side plates 18, 20.

In a preferred embodiment, the lines of weakening are formed as V-shaped notches as shown by the line of weakening 74 in FIG. 5. The sides of the V-shaped notches forming the lines of weakening are angularly spaced approximately 90° and the depth of each notch will be approximately half way through the thickness of the side piece. In the embodiment illustrated, the depth of each of the notches forming a line of weakening 70, 72, 74 is 0.8 mm.

Of course, the depth of each notch may be varied depending upon the thickness of the material as well as the distance between the parts 56, or the parts 50, 54 in the respective edges 38 and 40. The lines of weakening are in fact square lines achieved by the process of coining. However, it is contemplated that the lines of perforation could be used in some instances. Further, any way of weakening metal along a line may be employed if desired.

The heat exchanger made according to the invention is fabricated by an inventive method that includes, as a first step, the step of assembling the components of the heat exchanger, namely, the headers 10, 12, the tubes 14, the side pieces 18, 20 and the serpentine fins 22 in a fixture so that the headers are spaced with the tubes spaced and extending between the headers into slots therein and side plates extending between the headers at the sides of the core together with serpentine fins located between adjacent tubes and between the side plates and the adjacent tube at each of the sides of the core. The side plates are typically, but not always, mechanically fixed at each end to the adjacent header. Prior to performing the foregoing steps, however, it will be understood that the side plates are fabricated to have a line of weakening at a point intermediate the ends 24, 26. Preferably, the embodiment disclosed will be employed but as will be apparent to those skilled in the art, other embodiments can be used as well. The point of weakening the side plate is to reduce its ability to withstand tension while not materially affecting its ability to withstand bending; and this is particularly facilitated where the score lines 70, 72, 74 are offset from one another as shown.

The resulting assembly is then subjected to brazing temperatures to both braze the components together and to allow the thermal stresses involved in the brazing process to sever each side piece at the point of weakening as a result of thermally induced stress. Whether severance actually occurs will depend upon the rate the assembly cools following brazing.

In some cases, the severing may not occur fully during the brazing process but when the heat exchanger is placed in use, it is sufficiently weakened in the side plates at the lines of weakening that, after a few thermal cycles of operation, the side plates will break in use well before damage to the tube to header joints or elsewhere in the heat exchanger can occur.

I claim:

1. In a heat exchanger including a pair of spaced, generally parallel headers, a plurality of spaced, generally parallel tubes extending between and in fluid communication with the interior of said headers, a pair of elongated side plates, one at each side of said heat exchanger, and extending between and connected to said headers and spaced from the adjacent tube at the corresponding side of the heat exchanger, and serpentine fins between adjacent tubes and said side plates, the improvement wherein each side plate includes at least one opening between its edges and having a periphery with part of said periphery in close proximity to at least one of said edges, and a score line in each said side plate extending from said part to said edge.

2. The heat exchanger of claim 1 wherein said opening is elongated and at an acute angle to the direction of elongation of the corresponding side plate.

3. The heat exchanger of claim 2 wherein said side plate is formed as a channel having a base and at lest one leg extending therefrom terminating in said one edge, and said opening is formed in said base and in said one leg and said score line is in said one leg.

4. The heat exchanger of claim 3 further including a second score line extending to the other of said edges.

5. The heat exchanger of claim 4 wherein said channel includes a second leg extending from said base in spaced relation to said first leg and said second score line extends to a second elongated opening at an acute angle to said direction of elongation and in side by side relation with said one opening, said openings having center lines that intersect in a V-shape.

6. The heat exchanger of claim 5 wherein there are two spaced sets of said one and second openings, each said set including one of each of said score lines.

7. In a heat exchanger including a pair of spaced, generally parallel headers, a plurality of spaced, generally parallel tubes extending between and in fluid communication with the interior of said headers, a pair of elongated side plates, one at each side of said heat exchanger, and extending between and connected to said headers and spaced from the adjacent tube at the corresponding side of the heat exchanger, and serpentine fins between adjacent tubes and said side plates, the improvement wherein each said side plate is channel shaped having a base and two, spaced upstanding legs extending from said base and terminating in opposite edges, first and second, elongated openings in each said side plate in side by side relation and having respective center lines that intersect in an acute angle, each of said openings having a periphery that includes a first part in close proximity to a corresponding one of said edges and a second part in close proximity to the other opening, said first and second parts being spaced from one another in the direction of elongation of said side piece, a first line of weakening at each said first part extending between a corresponding one of said openings and the adjacent one of said edges and a second line of weakening extending between said openings at said second part.

8. The heat exchanger of claim 7 wherein said acute angle is on the order of 90°.

9. The heat exchanger of claim 7 wherein said lines of weakening have a length of about 4.6 mm or less.

10. The heat exchanger of claim 7 wherein said first and second lines of weakening are defined by V-shaped notches in said legs and said base respectively.

11. The heat exchanger of claim 10 wherein said heat exchanger consists essentially of aluminum or aluminum alloy parts brazed together and said side plates are severed at said lines of weakening.

12. The heat exchanger of claim 7 wherein said openings are generally oval shaped.

13. A method of making an aluminum heat exchanger comprising the steps of:

a) assembling the components of a heat exchanger core in a fixture to have spaced headers, spaced tubes extending between the headers, side plates extending between the headers and at the sides of the core and serpentine fins located between adjacent tubes and between the side plates and the adjacent tube at each side of the core;

b) prior to step a) weakening the side plate at a point intermediate its ends so as to reduce its ability to withstand tension while not materially affecting its ability to withstand bending;

c) subjecting the assembly resulting from step b) to brazing temperatures to i) braze the components together and ii) allow the severance of each side plate at said point as a result of thermally induced stress.

14. The method of claim 13 including the step of mechanically fixing each end of each side piece to the adjacent header.

* * * * *